US006155602A

United States Patent [19]

Mylander et al.

[11] Patent Number: 6,155,602

[45] Date of Patent: Dec. 5, 2000

[54] PAGE PROTECTION SYSTEM FOR PHOTO ALBUMS AND THE LIKE

[75] Inventors: Paul H. Mylander, North Attleboro, Mass.; Randall Dale Williams, Cornish, N.H.

[73] Assignee: Intercraft Company, Statesville, N.C.

[21] Appl. No.: 09/392,882

[22] Filed: Sep. 9, 1999

[51] Int. Cl.[7] ..... B42D 15/00

[52] U.S. Cl. ..... 281/42; 283/72

[58] Field of Search ..... 281/42, 45, 28, 281/38, 29, 37, 51; 402/73; 283/72, 117, 80; 340/571

[56] References Cited

U.S. PATENT DOCUMENTS 2,953,115 9/1960 Haskins ..... 281/42 X
4,162,800 7/1979 Gonot, Jr. et al. ..... 281/42
5,054,816 10/1991 Rosengarten ..... 281/42
5,510,768 4/1996 Mann ..... 340/571
5,560,657 10/1996 Morgan ..... 283/80

*Primary Examiner*—Willmon Fridie, Jr.
*Attorney, Agent, or Firm*—Foley & Lardner

[57] ABSTRACT

A page protection system according to the present invention includes a band of material encircling the pages and a cover of an album, the band being snug enough to prevent removal of the pages without cutting or removing the band. In the most preferred embodiment of the present invention, the page protection system includes album ring elements secured to the back cover, rather than the spline of the album and a band made of transparent, synthetic, and heat sealable and/or heat shrinkable plastic material. The band should not be easily torn and not easily removable. It is preferably located near the rings, for example within about 1.5 inches from the ring elements if the elements are mounted to the spline of the album and adjacent the ring elements if they are mounted to an album cover.

22 Claims, 4 Drawing Sheets

PAGE PROTECTION SYSTEM FOR PHOTO ALBUMS AND THE LIKE

BACKGROUND OF THE INVENTION

1. Field of the Invention

The present invention relates generally to the art of ring binders, such photo albums, school notebooks and the like. More particularly, the invention relates to a system for preventing the removal of pages from the album in a retail establishment and reducing the amount of page theft and product destruction which currently takes place. The page protection system prevents the removal of pages from one album and the placement thereof in a another album being purchased by a retail customer or the addition of refill sets to a new album. After removal of the protection system pages may be removed or added easily and quickly.

2. Description of the Prior Art

Ring binders of all sorts and sizes are well-known in the art and are used for photo albums, school notebooks, presentation materials, etc. Typically, such products include a plurality (two and three being the most common) of ring element pairs, at least one of which has a generally C-shape. The ring element pairs each have ends which can be opened or placed together. When opened, pages for the binder or album can be placed over the rings or removed. When closed the pages are held securely. If both of the ring elements are C-shaped, a generally circular ring is formed, and if one of the ring pairs is C-shaped and the other is L-shaped, the well-know D-ring is formed. In most cases, the rings are mounted on a ring binder body which is secured by fasteners to the spline of a photo album. It is also known to attach the ring binder body to the rear cover of the binder.

A variety of ring mounting and opening systems are also well-known, most of which may be used with the present invention. The simplest includes a pair of elongate metal plates mounted behind a ring binder body, the non-contacting ends of the ring elements passing through a front surface of the body and being joined to separate plates. The ring elements are opened and closed by merely pulling apart the contacting ends of the ring elements. Most of such systems "snap" into the fully opened or fully closed positions, due to the manner in which the plates are mounted to the back of the binder body.

Other ring closure systems are also very common. One of these includes a tab, located at an end of the ring binder body, pressure on which causes the plates, and the attached ring elements to snap into their open positions. These devices can be closed, either by manual pressure on the ring elements or by lifting up on the aforementioned tabs.

Several problems are still being encountered in the retail sale of such binders and albums. The main problem occurs when a customer unlawfully opens the ring elements to remove, add to or substitute pages for those which are supplied by the manufacturer. As an example, photograph albums are typically sold with a predetermined number of album pages, each designed to support a plurality of photographs. The albums, however, are designed to hold many more pages, and the manufacturer makes, and the retailer sells, "refill sets". Unfortunately, it is common for a customer to open a new album, insert refill sheets and close the album, discarding the packaging of the refill sheets. The customer then presents the enlarged album to the checkout person who scans the UPC code of the album itself and does not notice the theft of the pages. Similar examples could be provide for other types of binders and pages, where punched paper sets, index sets, colored dividers and the like, each made to be sold separately, are placed into the binder before the product is taken from the store. When customers remove pages from one book and insert them into another, or insert refill sets or other products into the binders, a theft occurs. One result is that consumers lose confidence in the retailer's product offerings, because some consumers may get less than what they are paying for. Retailers lose sales because their inventory shows unusable product or the loss of the refill sets causing, on occasion, the retailers to mark down product. Manufacturers end up paying warranty claims, when the product was perfect when it was manufactured. Overall, this is a losing proposition for all involved.

The theft of refill sets and other similar "accessories" for ring binders and albums costs manufacturers and retailers hundreds of thousands of dollars annually, and a solution to this problem which would not significantly increase the manufacturing cost of the products would represent a significant advance in the art. Currently, the only truly effective method for preventing thefts is to apply a shrink wrap around an entire product. This method, however, is unsatisfactory because the customer typically wants to open and view the product before purchase. Using photo albums again as the example, the customer may want to know whether the photograph pages may be used on both sides, whether they are sized for particular size photographs, etc. Heretofore, when shrink wrap has been used around the entire product, sales of that product are lower than for those which the customer can open and inspect.

Other methods have also been tried. One is the use of heat shrinkable loops placed around the individual ring element pairs and is described in U.S. patent application Ser. No. 09/108,936 filed Jul. 1, 1998 by Randall D. Williams and entitled "SAFETY SEAL RING LOCK". This application is assigned to the Assignee of the present invention.

FEATURES AND SUMMARY OF THE INVENTION

The present invention features a page protection system which uses a low cost band of material which is placed around the pages and a cover of an album, the band being preferably transparent and tear-proof.

A further feature of the present invention is a page protection system which does not add significantly to the labor cost of preparing binders or albums and which does not significantly reduce manufacturing line speeds.

Another feature of the present invention is to provide a page protection system in which the albums and the pages are not damaged by the system.

A different feature of the present invention is to provide a page protection system which reduces retailer costs, consumer complaints and warranty claims.

Yet a further feature of the present invention is to provide a page protection system which improves inventory turns by providing an attractive binder or album which can be opened and viewed by the customer, instilling consumer confidence in receiving full value.

A different feature of the present invention is to provide a page protection system which may be easily removed by the consumer when the product is taken home.

How these and other features of the invention are accomplished will be described in the following detailed description of a preferred embodiment thereof, taken in conjunction with the FIGURES. Generally, however, they are accomplished by providing a ring binder or album including at least two pairs of ring elements which are designed to be opened and closed to permit the addition or removal of pages. After manufacture and prior to shipment to the retail establishment, a band is placed about the pages and a cover of the binder, preferably the back cover, the band being snugly applied to prevent a customer from being able to remove pages from the binder while the band is in place. In the most preferred and illustrated embodiment of the invention, the binder ring elements are D-shaped, the band is made from a transparent, synthetic resin which is heat shrinkable and/or heat sealable to itself, and the band is applied about the pages and the back cover of the binder. In the most preferred embodiment of the invention, the band is approximately 2 inches wide, and the edge of the band closest to the ring elements is preferably located next to the band when D-rings are attached to the back cover and between about 1 and 2 inches when C-rings are on the spline of the book, about 1.5 inches being most preferred. Also, in the most preferred form of the invention, the band is transparent so that the aesthetics of the pages and the album may be fully appreciated by the consumer. The band is tear-proof, i.e. it is difficult to remove, except by cutting it with a sharp implement, such as a knife or a pair of scissors or by destroying a decal sealing the ends of the band. Other ways in which the features of the present invention are accomplished will become apparent to those skilled in the art after they have read the following detailed description. Such other ways are deemed to fall within the scope of the present invention if they fall within the scope of the claims which follow.

DESCRIPTION OF THE DRAWINGS

In the following drawings, like reference numerals will be used to designate like components.

DETAILED DESCRIPTION OF THE PREFERRED EMBODIMENT

Figure 1:
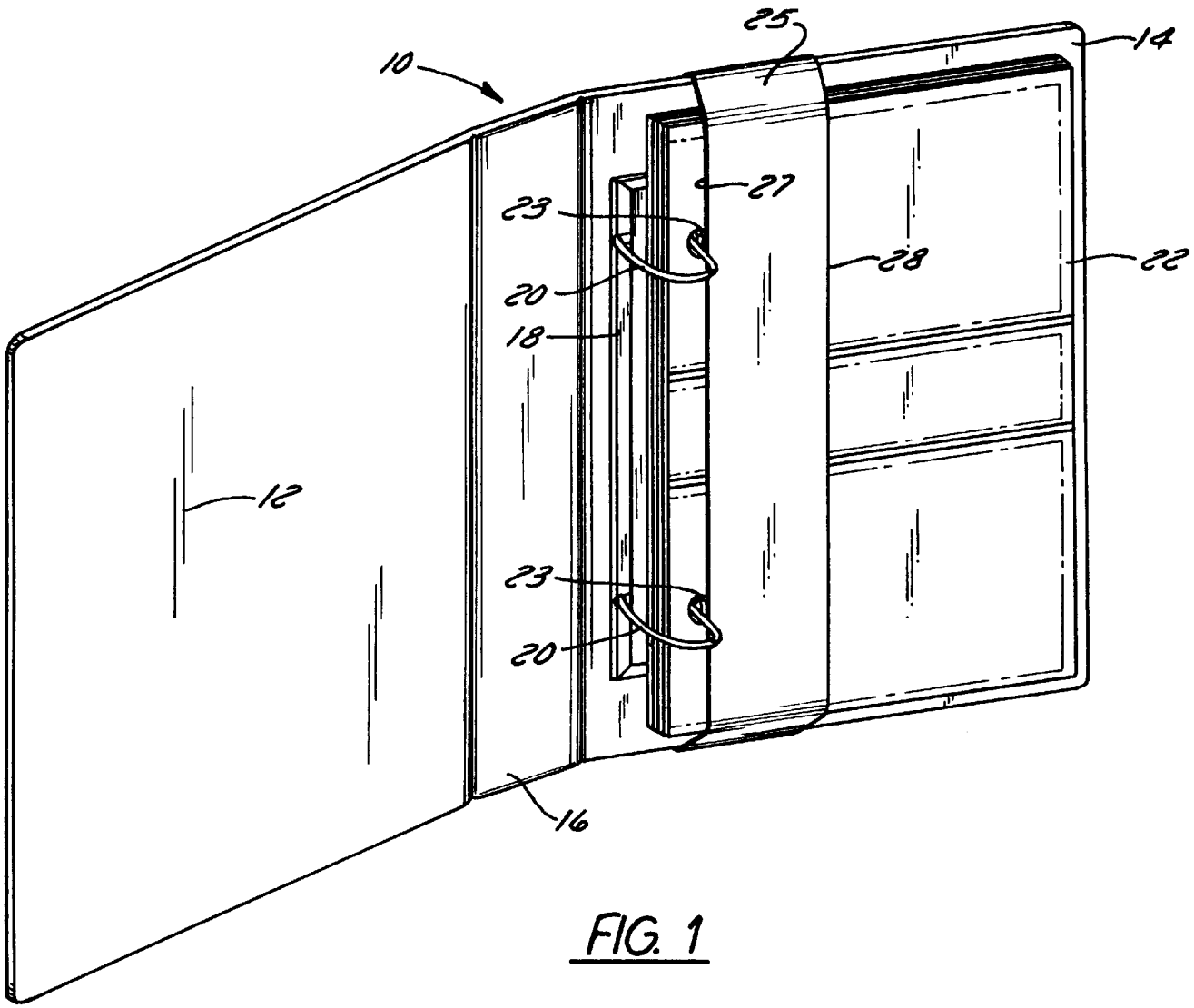
FIG. 1 is perspective view of a photo album according to the most preferred form of the present invention and showing the ring elements closed, photo album pages secured by the rings and a band.

Before beginning the detailed description of the preferred embodiment and alternates thereof, several general comments can be made about the applicability and the scope of the present invention.

First, the terms "album" and "binder" are used interchangeably to describe articles which include at least a front and a back cover and in most cases a spline therebetween. Binders or albums are found in a large variety of applications, including books used for academic and professional applications, presentation materials and photo albums. The illustrated embodiment will use photo albums, since that is the business of the Assignee of this invention.

Second, the materials used to construct the covers, pages, ring body and ring elements are conventional and, in and of themselves, do not form part of the invention.

Third, D-shaped rings are used in the most preferred embodiment, but the common C-shaped rings may also be used without departing from the invention's intended scope.

Fourth, the preferred band used in the illustrated embodiment is prepared from a heat sealable or heat shrinkable synthetic resin such as polypropylene or polyethylene, but other band materials may be employed, such as foils or cloth. The band preferably should be strong enough to resist easy removal, such as by scratching it with a finger nail or tearing it using light tearing forces and is preferably 1.4 to 2 mils thick. A preferred band material is 2002 Biaxially Oriented Polypropylene available from Roberts Technology, Montgomeryville, Pennsylvania. Furthermore, the band material should be pliable enough so that it will not damage an album cover or the pages when wrapped tightly around them.

Fifth, the preferred band is also transparent, so that the aesthetics of the cover and the consumer's opportunity to view the pages is not impeded. For some applications, however, it may actually be desirable for aesthetic purposes to use colored, translucent or opaque bands which may or may not be printed.

Sixth, the preferred embodiment uses a band which is placed very near to the binder ring body and the ring elements, to make it more difficult for someone intent upon removal of pages to manipulate the holes of the pages up and off the rings. However, in some applications, the placement of the band may not be as critical, especially if the band is snug enough.

Sixth, the term "not easily removable" as used in the specification and in the claims appended hereto, means that the band cannot be removed by using a fingernail or a light tearing force or by simply sliding the band away from the ring elements and off the edge of the pages. Heat sealing and/or shrinking of a synthetic resin and the attachment of a band about the pages using a decal to cover overlapped ends of the band are preferred ways in which this result can be achieved, but the invention is not to be limited to these two techniques, as others will appear to those skilled in the art after reading the specification. For example, the band might be stapled to the cover or affixed thereto using an adhesive, which embodiments are entirely functional, even though they may have aesthetic or other impacts on the system.

Proceeding now to a description of FIG. 1, a photo album 10 includes a front cover 12, a rear cover 14 and a spline 16. In addition, a ring binder body 18 includes two pairs of ring elements 20 which may be opened and closed for insertion and removal of photo album pages 22. As indicated previously, the materials, sizes and types of pages may vary widely, as will be appreciated by those skilled in the art.

FIG. 1 also shows a band 25 which encircles the pages 22 and back cover 14. In this FIGURE, and in FIG. 4, the band 25 is shown as a continuous band. Band 25 is preferably made from the heat sealable and/or shrinkable plastic materials described above and includes an inner edge 27 and an outer edge 28. In the illustrated FIG. 1, edge 27 lies very close to the ring elements 20.

In FIG. 1, the ring elements 20 are shown to be generally D-shaped and the binder body 18 is located on the back cover 14. In this embodiment, the album 10 may be opened without causing any movement of the pages 22 with respect to the band 25. Accordingly, the band may be placed as close as practical to the ring elements 20 to make it as difficult as possible for someone intent on misusing the product the holes 23 of pages 22 up and over the opened ring elements 20. Even if the ring elements 20 are opened, the pages 22 which are supplied by the manufacturer cannot be removed.

Figure 4:
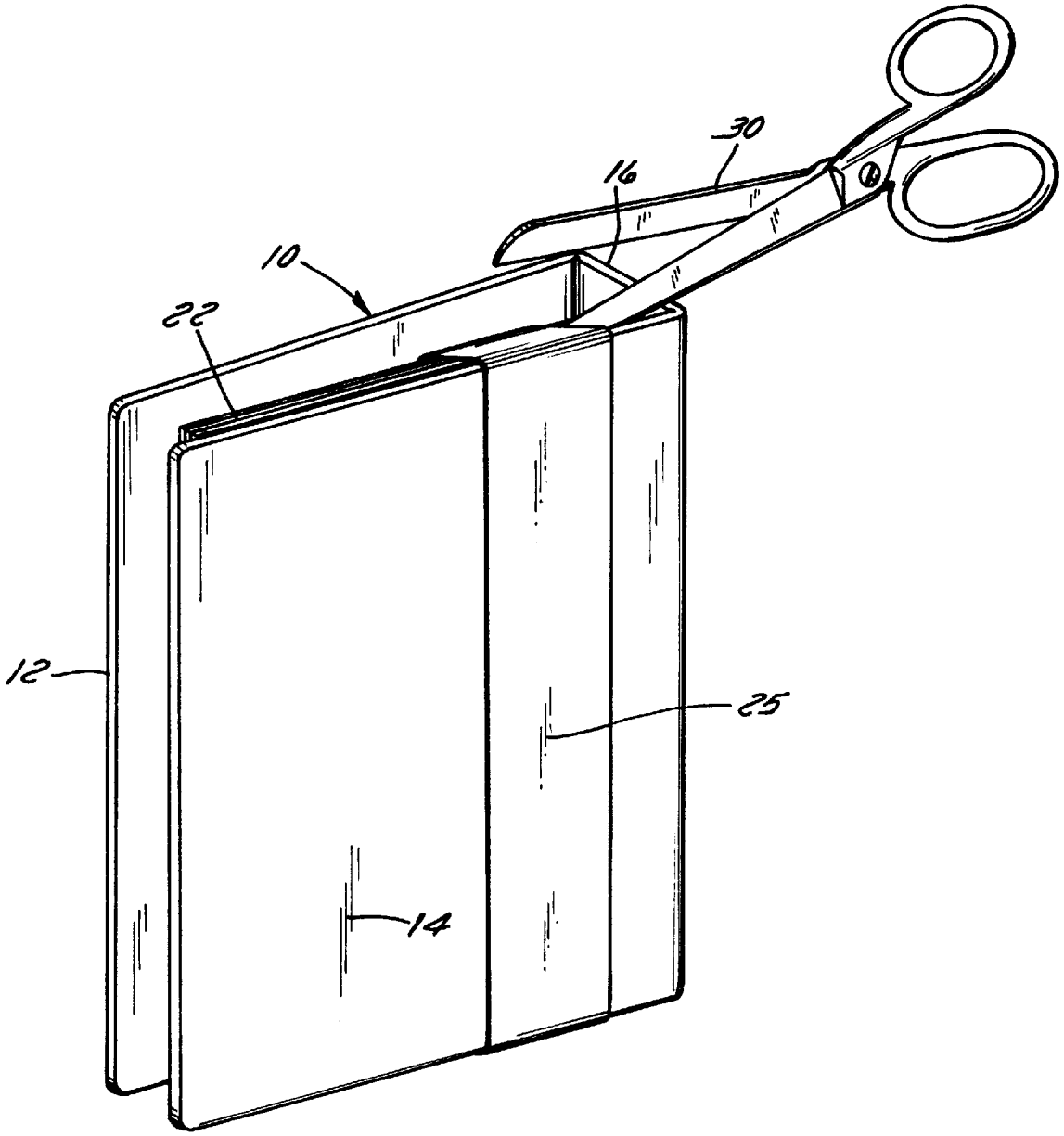
FIG. 4 is a diagrammatic perspective view of a pair of scissors being used to cut the band to allow the purchaser to use the album.

When the album 10 is taken home by the customer, band 25 can be removed, such as by using the pair of scissors 30, illustrated diagrammatically in FIG. 4. Other cutting tools or implements could be used, such as a knife.

Figure 2:
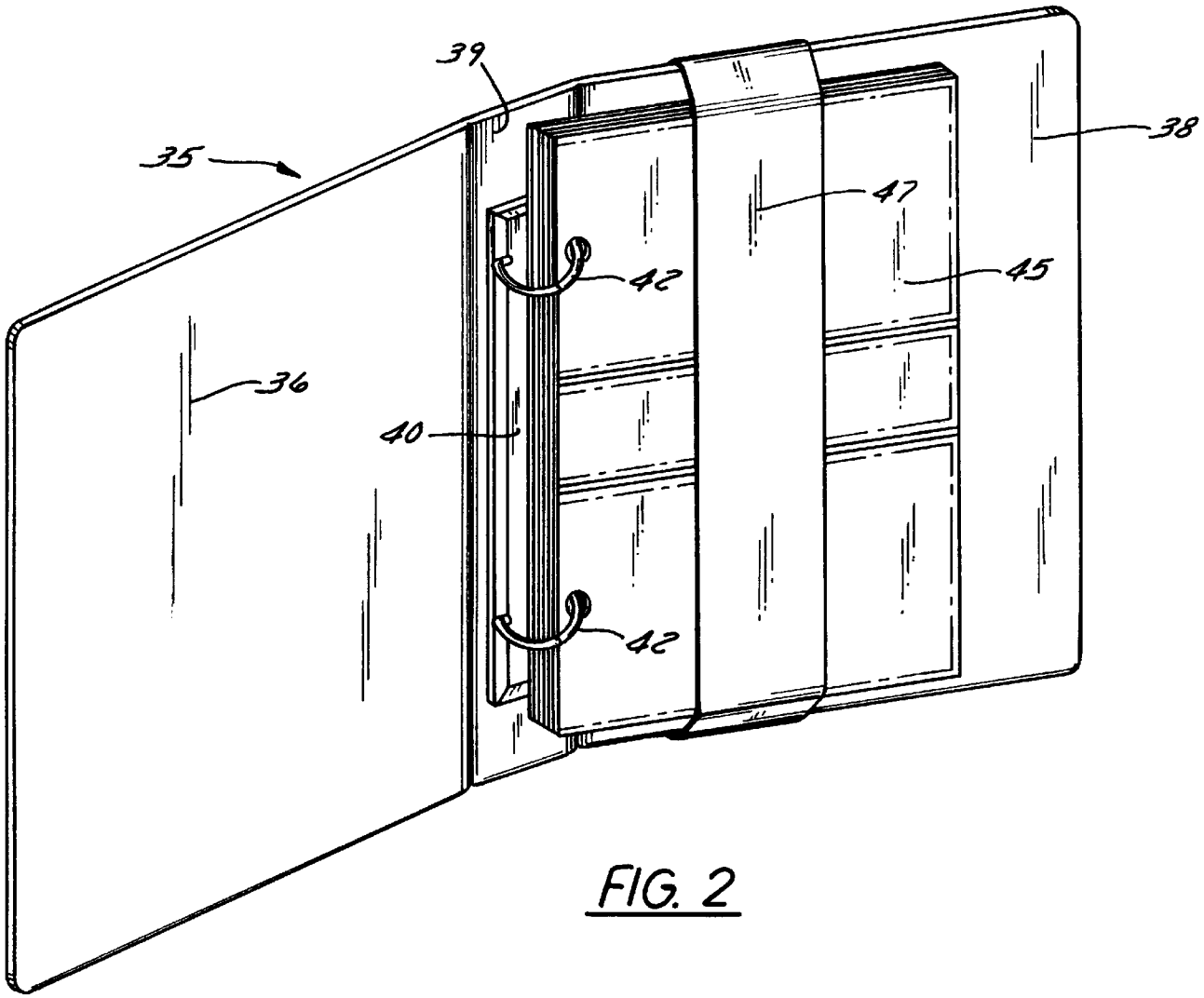
FIG. 2 is a perspective view of an alternate form of the invention in which the ring binder body is placed on the spline of the album rather than on the back cover.

A different embodiment of the invention is shown in FIG. 2 where a photo album 35 includes a front cover 36, a back cover 38 and a spline 39. The binder ring body 40 in this instance is applied to the spline and C-shaped ring elements 42 are shown. The pages 45 are held in this embodiment by a band 47 which is similar to the band 25 shown in FIG. 1, except that it is placed at a greater distance from the ring elements 42. Such distance is necessary to permit the pages 45 to slide beneath the band 47, because when the album is opened, the pages 45 move with respect to the back cover 38. This embodiment may be further altered by using the D-shaped rings shown in FIG. 1, or by making the other modifications which are mentioned in connection with the other embodiments.

Figure 3:
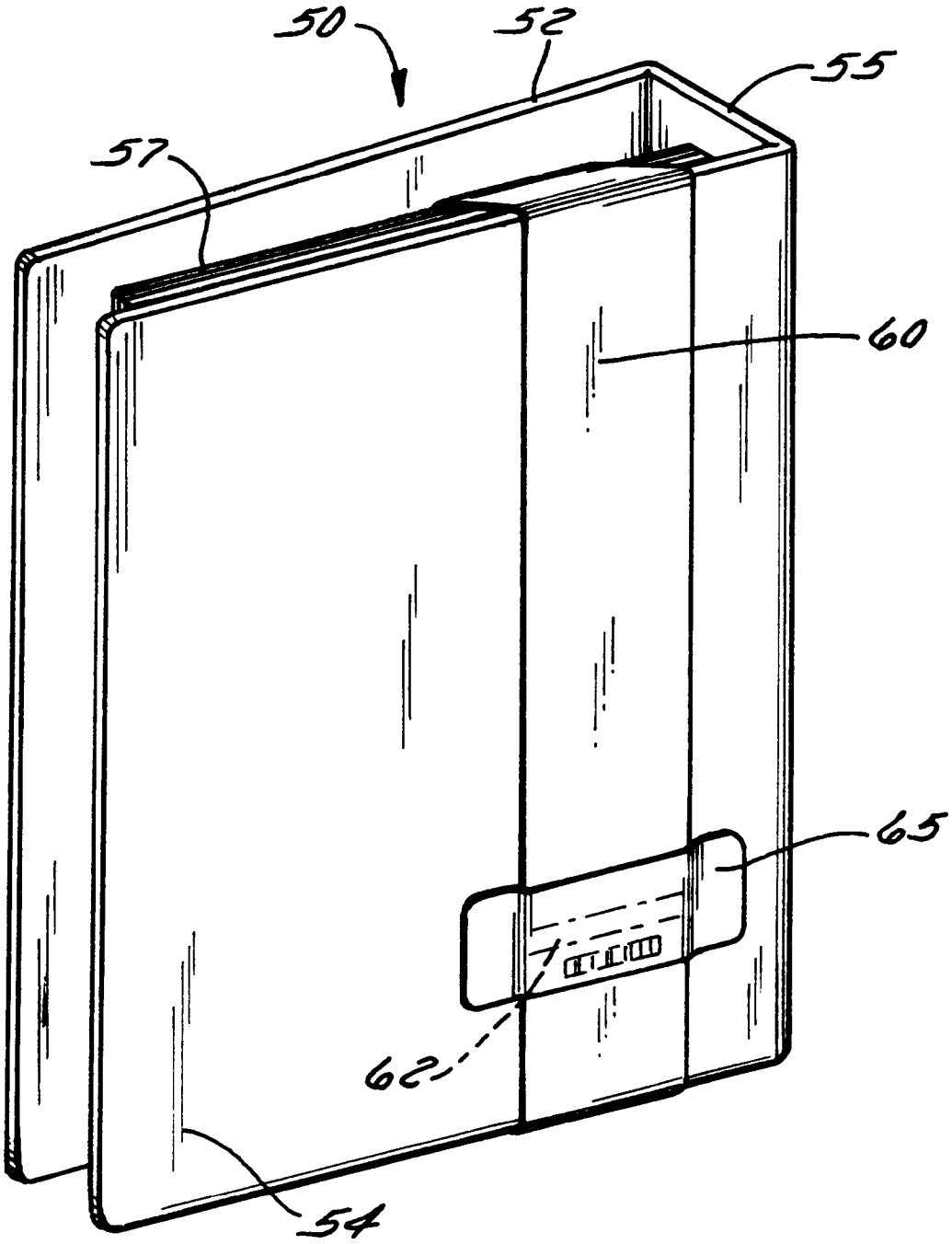
FIG. 3 is an enlarged elevation view showing a portion of the back cover of an album and a decal used to cover the overlapped ends of a band and which is adhered to both the album cover and the band, the band being torn to remove the band.

A third embodiment of the invention is shown in FIG. 3, where a photo album 50 includes a front cover 52, a rear cover 54, a spline 55, photo album pages 57 and a band 60. In this embodiment, the band is made from a strip which is wrapped around the pages 57 and the back cover 54 and the ends of which are overlapped or attached as indicated at reference numeral 62. The ends may be heat sealed to each other, if overlapped. A decal 65, which may also include product identification, pricing (UPC) codes, or other relevant information, is applied over the overlapped or abutted ends 62 and is preferably sealed to the band and the back cover. Sealing to the band is not essential, if the decal bond to the album 80 is sufficient to indicate to a check-out clerk any attempt to tamper with the product. To remove the band in this embodiment, the decal 65 must be torn or otherwise removed. This would provide a ready indication of product tampering. However, the decal 65 may be easily torn and removed by the customer after the product has been purchased and taken home. The particular location of the decal is not important, and it could be placed on the inside of the album as opposed to the illustrated location on the outside. Moreover, the decal 65 and the ends could be located near the top, as opposed to the bottom of the album 50.

While the present invention has been illustrated and described in connection with certain preferred embodiments, the invention is not to be limited thereby, but is to be limited solely by the scope of the claims which follow.

What is claimed is:

1. A page protection system for an album of the type which includes ring elements and pages removably held thereby comprising:

an album having front and back covers;

a binder body having at least one pair of ring elements coupled thereto, the ring elements being arranged to be opened and closed for the additional or removal of pages;

pages held by the ring elements;

a band snugly extending about one cover and the pages, the band being parallel to the binder body and being not easily removable from the album;

and wherein the band is cost ed from a heat shrinkable synthetic resin which is made not easily removable by heat the band to shrink it after it has been placed in the desired location so that removal of the band is not possible without destruction thereof.

2. The page protection system of claim 1 wherein the band is not easily torn.

3. The page protection system of claim 1 wherein the band is made from a synthetic plastic material selected from the group consisting of polyethylene and polypropylene.

4. The page protection system of claim 1 wherein the band is transparent.

5. The page protection system of claim 1 wherein the band is a ring which is rendered not easily removable after it is located at its desired location.

6. The page protection system of claim 1 wherein the band is a strip having first and second ends, the first and second ends of the strip being sealed together as part of the process for rendering the band not easily removable.

7. The page protection system of claim 6 wherein a decal is placed over the first and second ends of the strip and is sealed to at least the cover, whereby the decal must be torn to remove the band from the album.

8. The page protection system of claim 1 wherein an edge of the band is located within three inches of the binder body.

9. The page protection system of claim 8 wherein an edge of the band is located within about 1.5 inches of the binder body.

10. The page protection system of claim 1 wherein the binder also has a spline and the binder body is located on the spline.

11. The page protection system of claim 1 wherein the binder body is located on the back cover of the album.

12. The page protection system of claim 1 wherein the binder rings are D-shaped binder rings.

13. The page protection system of claim 1 wherein at least two sets of D-shaped binder rings are included.

14. The page protection system of claim 1 wherein a plurality of photo album pages are received by the binder rings.

15. An album page protection system for an album including a front cover having an outer surface and a back cover having an outer surface, an elongate ring binder body and a plurality of sets of ring elements, the system comprising:

an elongate plastic band having first and second ends wrapped snugly about the pages and an outer surface of a cover and being arranged to be parallel to the ring binder body; and a tearable seal overlying the ends of the band being attached to the album.

16. The page protection system of claim 15 wherein the band ends are heat sealed to one another.

17. The page protection system of claim 15 wherein the seal is adhesively attached to the album.

18. The page protection system of claim 15 wherein the seal is adhesively attached to the album and to both ends of the band.

19. The page protection system of claim 15 wherein the seal is attached to the outer surface of a cover of the album.

20. The page protection system of claim 15 wherein the band is not easily removable from the album.

21. The page protection system of claim 15 wherein the band is not easily torn.

22. The page protection system of claim 5 wherein the band is made from a material selected from the group consisting of polyethylene and polypropylene.

* * * * *